US006851576B2

(12) United States Patent
Dubach

(10) Patent No.: US 6,851,576 B2
(45) Date of Patent: Feb. 8, 2005

(54) CLOSING DEVICE WITH A PIERCING ELEMENT

(75) Inventor: Werner Fritz Dubach, Maur (CH)

(73) Assignee: Terxo AG, Wetzikon-Kempten (CH)

( * ) Notice: Subject to any disclaimer, the term of this patent is extended or adjusted under 35 U.S.C. 154(b) by 0 days.

(21) Appl. No.: 10/481,716

(22) PCT Filed: Jun. 10, 2002

(86) PCT No.: PCT/CH02/00307

§ 371 (c)(1),
(2), (4) Date: Dec. 19, 2003

(87) PCT Pub. No.: WO03/002419

PCT Pub. Date: Jan. 9, 2003

(65) Prior Publication Data

US 2004/0149786 A1 Aug. 5, 2004

(30) Foreign Application Priority Data

Jun. 27, 2001 (CH) ..... 1182/01

(51) Int. Cl.[7] ..... B65D 5/74
(52) U.S. Cl. ..... 222/83; 220/277
(58) Field of Search ..... 222/83, 541.2, 222/541.5; 220/277

(56) References Cited

U.S. PATENT DOCUMENTS 5,020,690 A * 6/1991 Kishikawa et al. ..... 222/83
5,027,979 A * 7/1991 Kawajiri et al. ..... 222/83
5,366,114 A * 11/1994 Bernstein et al. ..... 222/83
5,482,176 A * 1/1996 Maietta et al. ..... 222/83
6,279,779 B1 * 8/2001 Laciacera et al. ..... 222/83
6,398,075 B1 * 6/2002 Laciacera et al. ..... 222/83
6,422,412 B1 * 7/2002 Sagawa ..... 222/83
6,477,743 B1 * 11/2002 Gross et al. ..... 222/83
6,571,994 B1 * 6/2003 Adams et al. ..... 222/83
6,702,161 B2 * 3/2004 Adams et al. ..... 222/83
2002/0179605 A1 * 12/2002 Miani et al. ..... 222/83
2004/0104245 A1 * 6/2004 Dubach ..... 222/83

FOREIGN PATENT DOCUMENTS

| | | |
|---|---|---|
| EP | 0 663 344 | 12/1994 |
| EP | 0 328 652 | 8/1999 |
| EP | 1 088 764 | 4/2001 |
| FR | 2 765 194 | 12/1998 |
| GB | 2 241 224 | 8/1991 |
| WO | 95/05996 | 3/1995 |
| WO | 99/62776 | 12/1999 |

* cited by examiner

*Primary Examiner*—Kenneth Bomberg
(74) *Attorney, Agent, or Firm*—Pauley Petersen & Erickson

(57) ABSTRACT

A closing device arranged above a pierceable point of a closed container including a lower part with a cylindrical discharge nozzle, a screw cover and a piercing element. The piercing element, which is open on both sides, is displaced downwards in an axial direction in a screw-like manner in a screw cover in the lower part of the closing device. The piercing element has two cutting elements offset at an angle which produce a continuous, interconnected cutting line, and a displacing element which shifts a partially cut-out tab of the container from a region of the discharge nozzle.

8 Claims, 3 Drawing Sheets

$\alpha = 120°$ $\alpha = 136°$

CLOSING DEVICE WITH A PIERCING ELEMENT

BACKGROUND OF THE INVENTION

1. Field of the Invention

This invention relates to a closure device of plastic which may be attached via a piercable location of a closed receptacle and which has a bung-like lower part with a cylindrical pour-out spout which is connected or connectable to the receptacle, and a screw cap which may be pushed onto the lower part, as well as a cylindrical piercing element which in the axial direction is open on both sides and which is displaceably mounted in the lower part, and during a screwing-off movement of the screw cap for the first time the piercing element moves helically downwards.

2. Discussion of Related Art

Closure devices of plastic and having three parts, as described above, and having a bung-like lower part with a cylindrical pour-out spout, of a cylindrical piercing element movable therein and a screw cap which moves the piercing element are known in varied forms. Such closure devices are attached to soft-packaging receptacles. The receptacles have multi-layered films which usually have one or more paper or cardboard layers, one or more plastic film layers and at least one blocking layer, for example of aluminium. In the region of the closure devices to be attached, the packaging has suitable pre-punched piercing locations. Usually, according to the piercing element of the closure device, only the innermost-lying compact plastic film layer and the aluminium layer need to be severed.

With most known forms the piercing element is designed so that the piercing element merely exerts a translatory movement towards the inside of the packaging. For example European Patent Reference EP-A-0,328,652 teaches a solution in which the screw cap has a guide-path-like helical line centrically incorporated on an inner wall, while the piercing element has a similar counter-running thread and simultaneously the piercing element has cams which prevent a rotation relative to the pour-out bung. A solution is also known from PCT International Publication WO 99/62776. Also Great Britain Patent Reference GB-2241224 teaches a closure device with a bung-like pour-out in which there runs a piercing element with guide cams, wherein the guide cams engage into axially running grooves and simultaneously the piercing element has an inner thread which cooperates with a centric annular wall of the screw cap, wherein the centric wall comprises an outer thread. Simultaneously, a threaded connection exists between the screw cap and the pour-out bung.

One solution taught by Great Britain Patent Reference GB-A-2241224 does not function with a piercable location in the packaging but the pour-out bung is welded from the inside to the inner wall of the packaging and an additional film is attached on the inside on the flange of the pour-out bung. Such a closure film may have any of properties which differ from the actual packaging. Accordingly, the piercing element may have practically any shape, for example as shown in FIG. 1 of this publication, or there may be several perforation teeth on the circumference of the piercing element. Completely analogous to this, in the embodiment according to European Patent Reference EP-A-0'328'652 there is a piercing element which has a multitude of perforation teeth on the lower edge, which is also the case with PCT International Publication WO 99/62776 which was mentioned.

In contrast, PCT International Publication WO 95/05996 shows a closure device in which the piercing element does not only carry out a purely translatory movement but also a screw movement. The piercing element comprises an outer thread which is meshingly guided into an inner thread in the pour-out bung. The piercing element may be set into a corresponding screw movement by a lug in the screw cap. If the screw cap is screwed off, then the piercing element moves simultaneously in a screw movement downwards into the receptacle to be opened. Also, the piercing element along its lower edge has a multitude of perforation teeth in a completely analogous manner to known devices.

Practically all known closure devices obtainable on the market today have significant problems. While initial solutions not documented here functioned practically without perforation teeth and with which the receptacle wall was destroyed somewhere, with perforation teeth it was believed that one could overcome the problem. This however was not the case. One of the main reasons is the fact that all known devices demand a large force effort on opening. Practically with all known devices, over the entire circumference many locations of the films are simultaneously perforated. If the teeth are located at exactly those locations which are vertically above the pre-separated film, then a solution would be possible. This however would demand a fastening of the closure device onto the receptacle which is exact to practically a tenth of a milimeter. This is simply not possible. Accordingly, the teeth also dig into regions of the packaging which are not pre-punched. Thus, not only is considerably more force required but also a pure pulling movement to the film is effected. While films mostly react sensitively to perforations, most films are extraordinarily resistant to tension forces.

The embodiment taught by PCT International Publication WO 95/05996, essentially a cutting effect is achieved instead of a piercing effect. Accordingly, the concept with a multitude of perforation teeth does not make sense. Also, with a small rotational angle the complete inner region is cut out of the packaging and falls into the contents of the receptacle. This is not only undesirable and unhygienic, but also during the pouring-out the loose part again and again gets into the pour-out region and leads to uncontrollable pour-out characteristics.

SUMMARY OF THE INVENTION

It is one object of this present invention to provide a closure device of the type having a simple opening but with features that avoid the disadvantages described in view of the above discussed prior art.

A closure device which has the features discussed in this specification and in the claims achieves this object.

With the selection of the offset angle $\alpha$ with a size of less than 180°, no complete separation out of the packaging region is possible, whereas with a selection of the offset angle of more than 100°, at the moment at which the displacing element becomes effective, more than half the circumference is severed and thus the already severed part may be folded away. The latter would also be given per se, even if the offset angle is less than 100°, but then there is a significant danger that the displacing element not only pushes the already separated region to the side, but also simultaneously causes the region not yet severed to tear. Finally, with an offset angle of less than 100° the open pour-out region is greatly restricted.

Further advantageous design forms of this invention are apparent in view of the claims and their significance and manner of acting, which is explained in the subsequent description with reference to the accompanying drawings.

BRIEF DESCRIPTION OF THE DRAWINGS

Each drawing shows a form of the subject-matter of this invention, wherein.

DESCRIPTION OF PREFERRED EMBODIMENTS

Figure 1:
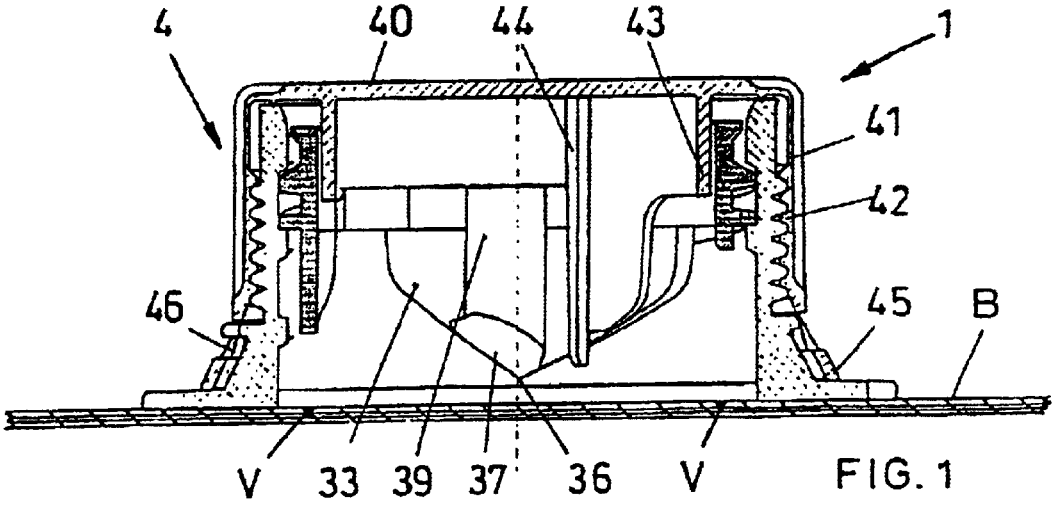
FIG. 1 shows a vertical section taken through a closure device in an assembled condition on a receptacle, before opening for the first time.

Although this invention essentially relates to the design of the piercing element, for a better understanding of the entire construction the closure device 1 comprising three parts is shown. These three parts are a lower part 2, which is adheringly attached to a receptacle B, a piercing element 3 which is screwably movably mounted therein and a screw cap 4 engaging over the lower part 2. The lower part 2 has a cylindrical pour-out spout 20, which at the end merges into a lower flange 21 and comprises an inner thread 22 and an outer thread 23. The flange 21 serves as an adhering connection to the receptacle B. The receptacle B includes a multi-layered soft packaging manufactured of films, wherein the multi-layered film comprises a so-called pre-punching V which partly passes through one or more layers and thus defines a nominal opening. For opening the receptacle B, the multilayered film has yet to be completely severed in the region of the pre-punching V. The flange 21 of the lower part may be welded or adhered on the multi-layered film of the receptacle B. The pre-punching V defines a circular surface which is within the opening of the cylindrical pour-out spout 20. The diameter of the pre-punching V is a few percent smaller than the diameter of the pour-out spout 20. In contrast, the diameter of the pre-punching V corresponds accurately to the diameter of the piercing element 3 or the circular path which the cutting elements of the piercing element define with their movement. The inner thread 22 of the cylindrical pour-out spout 20 is a coarse thread. Thus, the thread height is relatively large and the thread has a larger pitch. Thus, with a rotation of about 360° or less the piercing element 3 is moved from its original assembly position, as shown in FIG. 1, into the lower position of use according to FIG. 2. Accordingly, the outer thread 23 is a fine thread. Thus, the thread 23 only has a slight height of the thread flanks and the pitch of the thread is flat. In order to screw off the screw cap 4 it needs to undergo several rotations.

Figure 2:
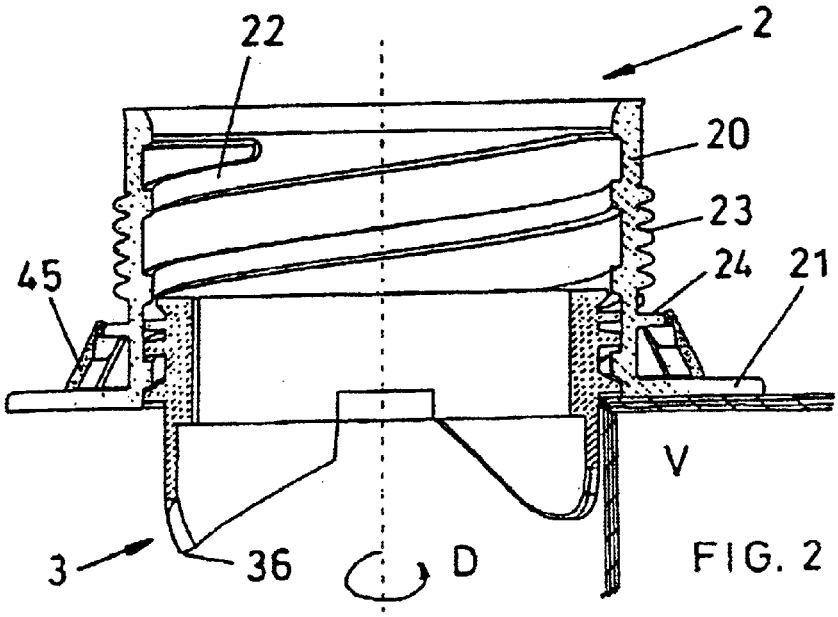
FIG. 2 is a view of the same closure device after opening for the first time, with a screwed-off screw cap, again in the assembled condition, in a diametrical vertical view.

The actuation of the piercing element 3 is effected by the screw cap 4. The screw cap 4 has a cover surface 40 on which a circumferential outer wall 41 borders. The outer wall 41 has an inner thread 42 which is designed as a fine thread, matching the outer thread 23 of the cylindrical pour-out spout. An annular wall 43 running concentrically to the outer wall 41 is integrally formed on the lower side of the cover surface 40. Means in the form of lugs 44 are integrally formed on this concentric annular wall 43 which has a diameter that is smaller than the inner diameter of the piercing element. With a rotation of the screw cap 4 the lugs 44 drive the piercing element 3 in a counter-running direction. While the screw cap 4 moves upwards, the piercing element is moved downwards because the threads between the screw cap 4 and lower part 2 are orientated running counter to the rotational direction of the thread between the piercing element 3 and the lower part 2. A guarantee strip 45 is integrally formed at the bottom on the outer wall 41 via break-off bridge locations 46. This is held in the secured position by retaining cams 24 and the guarantee strip 45 remains here even after opening for the first time, as shown in FIG. 2.

Figure 3:
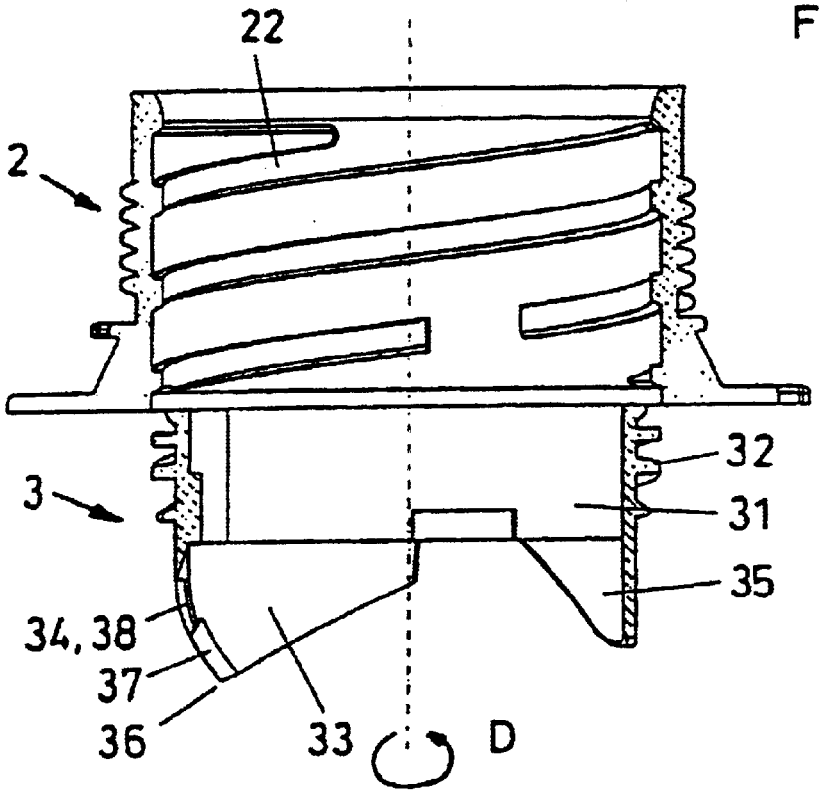
FIG. 3 shows the piercing element in a position of manufacture connected as one piece to the lower part, in a diametrical vertical section.
Figure 4:
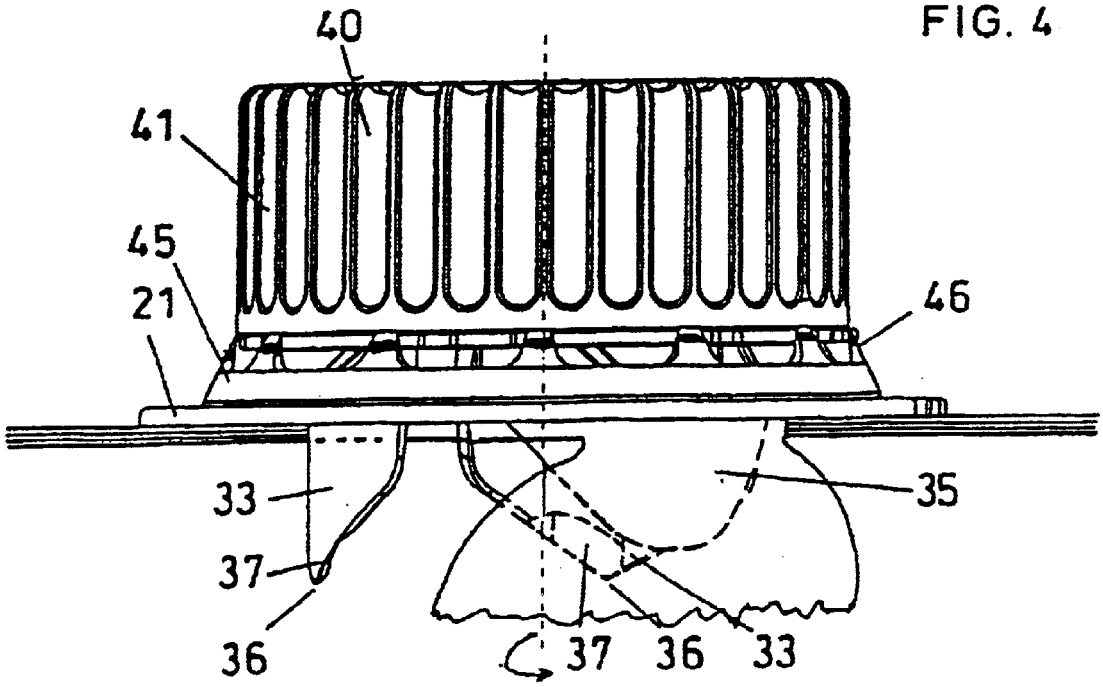
FIG. 4 shows a front view of the closure device in the assembled condition in the position of use, wherein only the packaging is shown in a partial view.

The piercing element 3 which as shown in FIG. 3 is advantageously manufactured with the lower part as one piece, essentially of an annular wall part 31 with an outer thread 32 which is designed as a coarse thread, matching the inner thread 22 of the lower part 2. At least two cutting elements 33 and at least one displacing element 34, 35 are integrally formed on the annular wall part 31. The displacing element 34 may be combined with the cutting element 33 or, as evident from FIGS. 1 to 3 may be designed as a separate element 35. In the section drawings according to FIGS. 1 to 3 in each case only one cutting element 33 is recognized. Only in the front view according to FIG. 4 are both cutting elements 33 visible. The cutting elements 33 which roughly have a triangular shape open into a terminal perforating tooth 36. An arrow D in each case shows the rotational direction of the piercing element. A cutting edge 37 connecting directly to the perforation tooth is integrally formed on the edge at the front in the rotational direction. The cutting edge 37 with the preferred embodiment form merges into a displacing edge 38 which thus forms the displacing element 34 and is a part of the cutting element 33. On the inner surface of the cutting element 33 above the cutting edge 37 there is integrally formed a lug thickening 39 on which a lug 44 bears during the screwing-off movement of the screw cap for the first time and thus sets the piercing element 3 into a screw movement. The displacing edge 38 is optional. As mentioned, an additional, separate displacing element 35 may be designed shorter in the axial direction of the piercing element 3 than the cutting element 33. Accordingly, the displacing element 35 only comes into contact with the film of the receptacle B when the two cutting elements 33 have at least approximately formed a continuous cutting line. The separate displacing element 35 otherwise has roughly the shape of the cutting elements 33, but is bluntly cornered and has no perforation tooth but runs in a rounded arc.

Figure 5:
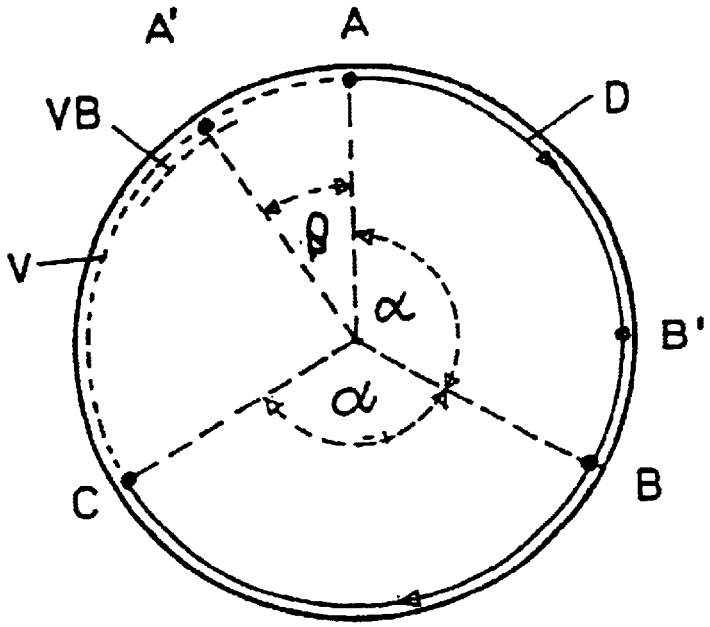
FIG. 5 and FIG. 6 each shows a schematic view of cutting and bending plans for two different offset angles α.
Figure 6:
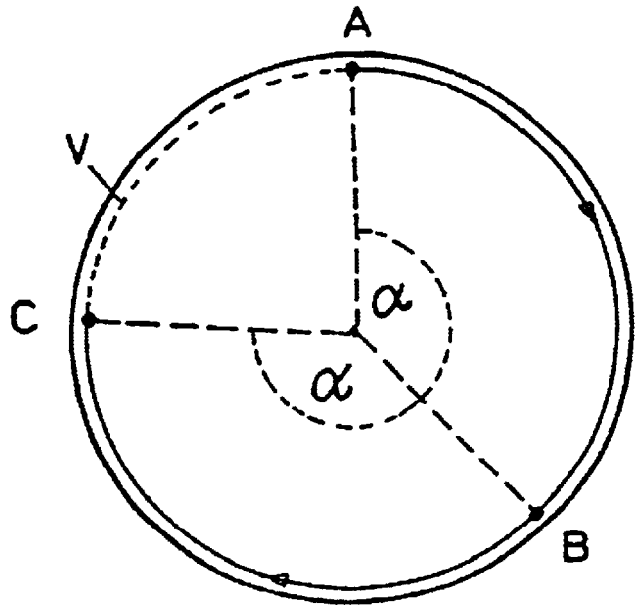

The action of the closure device according to this invention is explained with reference to FIG. 5 and FIG. 6. The two cutting elements 33 are arranged following one another by an offset angle α. In the initial position before opening the closure device for the first time the two perforation teeth 36 of the two cutting elements 33 are located at the positions a' and b'. After a certain advance angle β the two perforation teeth 36 contact the film of the receptacle to be severed at the points A and B. With reference to the rotational direction D the perforation tooth of the one cutting element runs ahead of the second cutting element by an offset angle α. With a further rotation in the direction D the perforation teeth 36 pierce the film and further sever the film, wherein the one cutting element runs through the cutting path from point A to point B, while the other cutting element defines a cutting line from point B to point C. Thus as soon as the piercing element is rotated by the offset angle α there results a continuous cutting line of 2α which extends from point A to point C. In this position the cutting edge 37 has inwardly penetrated the film of the receptacle at least approximately completely, and the displacing edge 38 and/or the displacing element 35 act from point C. The displacing edge acts from point C while the displacing element 35 in the region VB which lies relatively close to the pre-punching V in the not yet severed region. Then the region cut free is pressed down into the receptacle in the manner of a flap. At the same time the pre-punching V practically serves as a bending line, such as shown in FIG. 2. The remaining, non-severed region of the pre-punching V is larger or smaller, according to the choice of the offset angle α. The offset angle α must theoretically be at least 90°, however this is not realized in practice and the actual minimum size of the offset angle α must be larger than 100°. The offset angle α must be smaller than 180° in order to ensure that the cutting line is not circumferential and as a result a complete round part is cut out of the film which could fall into the receptacle. Realistically, the maximum offset angle α may be about 170°. The solutions shown in FIGS. 5 and 6 relate to realistic details. If one operates with a separate displacing element 35 then the offset angle α may tend to be smaller because the displacing element may already be pressed onto the film before the cutting element at the front in the rotational direction has reached the point C, by which the film is pressed slightly downwards and thus a somewhat longer continuous cutting line arises than the theoretical cutting line.

In comparison to the previously known piercing elements with a multitude of perforation teeth, the perforation of this invention is effected only at two points. This has one advantage that the required force is smaller. Simultaneously, here a real cutting movement is effected. The cutting edge 37 specifically carries out a movement component perpendicular to the cutting line as well as a component in the direction of the cutting line. However, because the pre-punching V also runs relatively close to the relatively rigid connection of the film to the flange 21 of the lower part 2 a certain shear force is effected.

Of course the gradient of the coarse thread between the piercing element 3 and the lower part 2 needs to be directed to the geometry of the cutting elements. The purely vertical length of the cutting edge 37 must be equal to the thread pitch which corresponds to the angle α, which is particularly the case if the displacing element is combined with the cutting elements.

What is claimed is:

1. A closure device of plastic which is attachable via a piercable location of a closed receptacle (B) and which has a bung-like lower part (2) with a cylindrical pour-out spout (20) which is connectable to the receptacle, and of a screw cap (4) which is screwable onto the lower part (2), as well as of a cylindrical piercing element (3) which in an axial direction is open on both sides and which is displaceably mounted in the lower part, and during a screwing-off movement of the screw cap for a first time the piercing element (3) is moved helically downwards, the closure device comprising: the piercing element (3) having at least two cutting elements (33) arranged running after one another by an offset angle (α) of less than 180° and more than 100° so that after a rotation of the piercing element (3) by the offset angle (α) a continuous cutting line of 2α arises, and a displacing element (34, 35, 38) acting in a non-separated region which pushes a partly cut-out lobe of the receptacle out of a region of the pour-out spout (20).

2. A closure device according to claim 1, wherein the displacing element is combined with a leading cutting element (33) into an element (34, 38).

3. A closure device according to claim 2, wherein the leading cutting element (33) has a cutting edge (37) which merges into a displacing edge (38) acting as a displacing element, the cutting element (37) is long enough that with a screwing movement after one rotation (D) of the piercing element (3) by at least approximately the offset angle α the displacing edge (38) pushes a non-separated region of the receptacle (B) out of the region of the pour-out spout (20).

4. A closure device according to claim 1, wherein in the rotational direction of the piercing element (3) there is a displacing element (35) which is separated from the cutting element and which runs ahead of the leading cutting element (33).

5. A closure device according to claim 4, wherein the two cutting elements (33) and the displacing element (35) are integrally connected with the piercing element (3).

6. A closure device according to claim 1, wherein the two cutting elements (33) and the displacing element (34) are offset concentrically to an outer wall of the cylindrical piercing element (3) towards a center approximately by a wall thickness of an annular wall part (31).

7. A closure device according to claim 1, wherein the piercing element (3) with the cutting elements (33) has a first axial length which corresponds maximally to a second axial length of the cylindrical pour-out spout (20).

8. A closure element according to claim 4, wherein the displacing element (35) is shorter than the two cutting elements (33) by an axial distance which corresponds to an axial movement path that the two cutting elements (33) travel with a rotation of the piercing element (3) by the offset angle α.

* * * * *